United States Patent [19]

Setzer et al.

[11] Patent Number: 4,989,436

[45] Date of Patent: Feb. 5, 1991

[54] SYSTEM FOR AXIALLY SHIFTING A ROLL IN A ROLL STAND

[75] Inventors: Helmut Setzer, Siegen-Geisweid; Axel Sprenger, Hilchenbach, both of Fed. Rep. of Germany

[73] Assignee: SMS Schloemann-Siemag Aktiengesellschaft, Düsseldorf, Fed. Rep. of Germany

[21] Appl. No.: 369,992

[22] Filed: Jun. 22, 1989

[30] Foreign Application Priority Data

Jun. 25, 1988 [DE] Fed. Rep. of Germany ..... 3821571

[51] Int. Cl.[5] ..... B21B 31/18

[52] U.S. Cl. ..... 72/247; 29/116.2; 384/556

[58] Field of Search ..... 72/247, 245, 237, 199; 29/116.2, 116.1; 384/556, 99

[56] References Cited

U.S. PATENT DOCUMENTS

| | | | |
|---|---|---|---|
| 3,003,836 | 10/1961 | Hill | 72/237 |
| 3,799,636 | 3/1974 | Kersting | 384/556 |
| 3,973,425 | 8/1976 | Woodrow | 72/247 |
| 4,191,042 | 3/1980 | Salter, Jr. | 72/247 |
| 4,589,269 | 5/1986 | Michaux | 72/247 |

FOREIGN PATENT DOCUMENTS

| | | | |
|---|---|---|---|
| 3628733 | 2/1988 | Fed. Rep. of Germany | 72/247 |
| 93507 | 6/1983 | Japan | 72/247 |
| 1435576 | 5/1976 | United Kingdom | 384/99 |
| 2141061 | 12/1984 | United Kingdom | 72/247 |

*Primary Examiner*—Daniel C. Crane

*Attorney, Agent, or Firm*—Herbert Dubno; Andrew M. Wilford

[57] ABSTRACT

A roll stand includes a generally stationary frame, a roll centered on an axis, and a radial-thrust bearing having an outer race fixed in the frame, an inner race fixed on the roll, and a plurality of rollers radially engaging the races and supporting the roll in the frame for rotation about the axis. The rollers are axially shiftable along one of the races. An axial-thrust bearing has outer and inner faces one of which is axially fixed to the roll and the other of which is axially movable in the frame and rollers between the respective outer and inner races. An actuator is braced axially between the roll and the frame for axially shifting the roll in the frame and thereby axially shifting the other of the radial-bearing races relative to the respective rollers and the one radial-bearing race.

6 Claims, 1 Drawing Sheet

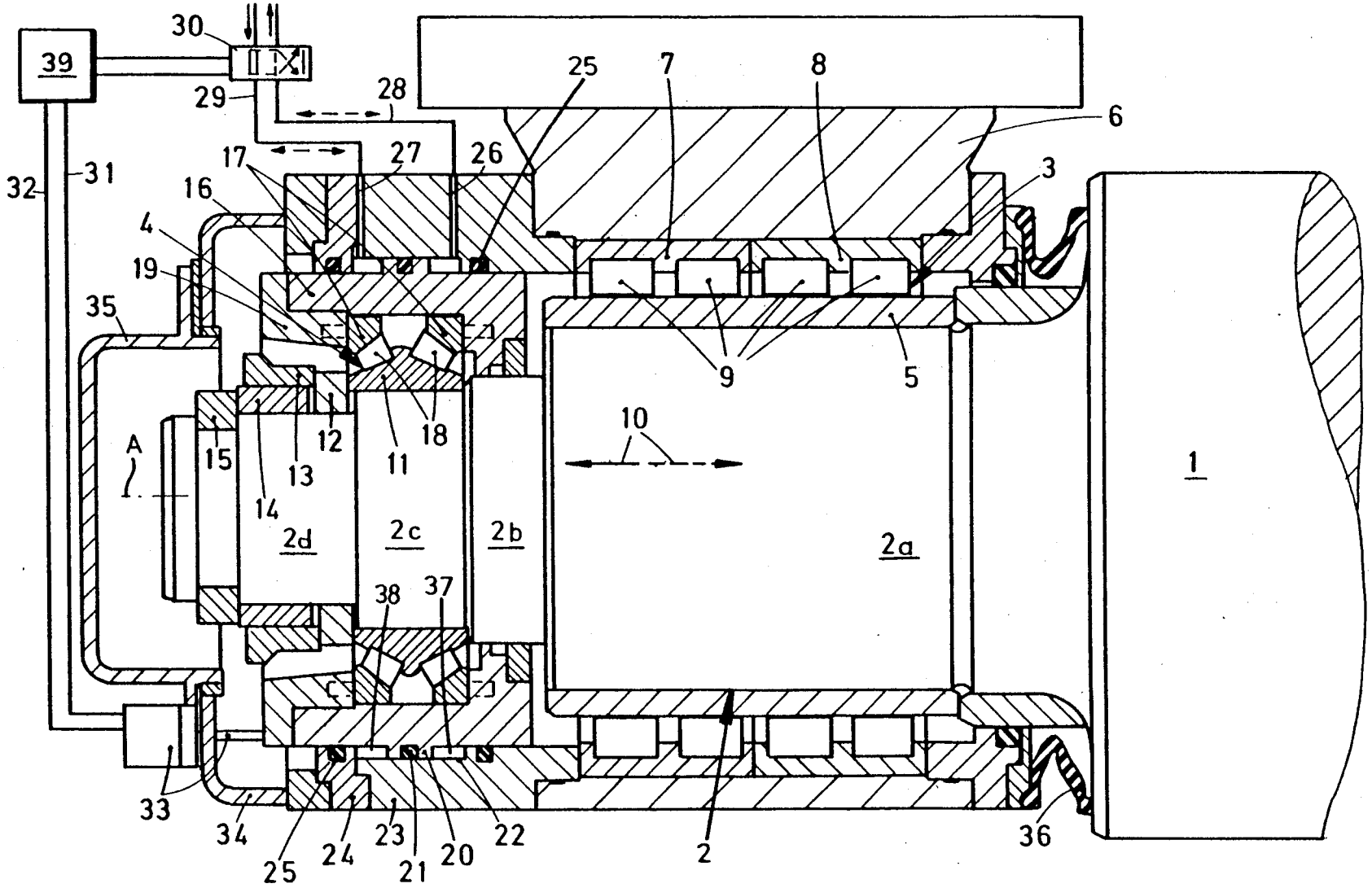
1
2
2a
2b
2c
2d
3
4
5
6
7
8
9
10
11
12
13
14
15
16
17
18
19
20
21
22
23
24
25
26
27
28
29
30
31
32
33
34
35
36
37
38
39
A

SYSTEM FOR AXIALLY SHIFTING A ROLL IN A ROLL STAND

FIELD OF THE INVENTION

The present invention relates to a hot- or cold-working roll stand. More particularly this invention concerns an apparatus for axially shifting a roll in such a stand.

BACKGROUND OF THE INVENTION

It is standard in a roll stand, whether used for hot or cold working of a metallic workpiece or crushing ore or the like, to provide an arrangement that allows the rolls to be axially shifted. In this manner workpiece shape, roll wear, groove formation, and the like can be controlled.

The standard such system as described in German patent document No. 3,521,180 has the stubs projecting from each end of the roll secured by respective axial- and radial-thrust bearings in journal blocks in turn mounted in slides in the frame of the roll stand. Powerful hydraulic actuators are effective axially between the journal blocks and the frame for shifting the roll, both journal blocks, and both sets of bearings. Clearly this takes a lot of force so that the axial-shift actuators must be very powerful, and in general the equipment must be expensive and complicated. What is more the actuators provided at the ends are fairly bulky, projecting considerably from the stand.

In U.S. Pat. No. 4,491,005 of Tomoaki another such system is disclosed wherein the journal blocks are largely eliminated, so that the axial shifter need merely move the roll and its two sets of bearings whose outer races are mounted in slides in the frame. Such an arrangement must still overcome considerable sliding friction, especially if the rolls are to be moved when they are working so that this arrangement has substantially the same disadvantages as the other above-described system. As in the other above-described system the considerable radial forces brought to bear make the effect of the sliding friction considerable.

OBJECTS OF THE INVENTION

It is therefore an object of the present invention to provide an improved roll stand with an axially shiftable roll.

Another object is the provision of such an improved roll stand with an axially shiftable roll which overcomes the above-given disadvantages, that is which uses a compact and relatively light-duty actuator for axially shifting the roll.

SUMMARY OF THE INVENTION

A roll stand includes a generally stationary frame, a roll centered on an axis, and a radial-thrust bearing having an outer race fixed in the frame, an inner race fixed on the roll, and a plurality of rollers radially engaging the races and supporting the roll in the frame for rotation about the axis. According to this invention the rollers are axially shiftable along one of the races. An axial-thrust bearing has outer and inner races one of which is axially fixed to the roll and the other of which is axially movable in the frame and rollers between the respective outer and inner races. An actuator is braced axially between the roll and the frame for axially shifting the roll in the frame and thereby axially shifting the other of the radial-bearing races relative to the respective rollers and the one radial-bearing race.

Thus with the system of this invention the actuator has to overcome no sliding friction. When the roll is to be shifted as it is rolling the force necessary to slide the rolls of the radial-thrust bearing relative to the one race is extremely small, so that a very compact and simple actuator can be used.

According to a further feature of this invention the actuator is a hydraulic piston-and-cylinder unit. The frame forms a cylinder chamber around the outer race of the axial-thrust bearing and this outer race is formed with a piston subdividing the chamber axially into a pair of compartments. These compartments can be alternately pressurized to axially shift the roll. Such an arrangement is extremely compact, hardly adding any bulk to the system so that the roll stand has virtually the same size as one without axially shiftable rolls.

The frame according to this invention is formed of a plurality of parts together defining the chamber. This construction makes it extremely easy to service the shifter. In addition the rollers of the axial-thrust bearing have cylindrical outer surfaces extending parallel to the axis and engaging the respective races. The radial-thrust bearing includes at least two sets of such rollers rotatable about respective axes inclined to the axis of the roll.

According to another inventive feature the outer radial-bearing race is formed with a radially inwardly open groove in which the respective rolls ride and the inner race of the axial bearing is axially substantially longer than the outer race. The maximum axial travel of the shiftable roll relative to the frame can be as much as 400 mm.

BRIEF DESCRIPTION OF THE DRAWING

The above and other objects, features, and advantages will become more readily apparent from the following, reference being made to the accompanying drawing whose sole FIGURE is a partly diagrammatic axial section through an end of a roll of a roll stand according to this invention.

SPECIFIC DESCRIPTION

As seen in the drawing a roll 1 of a roll stand is centered on an axis A for rotation thereabout relative to a stationary housing or frame 6. This roll 1 has at each end (only one shown) a cylindrical end stub 2 supported in the frame 6 on a radial-force bearing 3 and braced axially thereagainst by an axial-force bearing 4. The unillustrated end of the roll 1 is supported on the other side of the frame 6 by another such radial-force bearing 3, but no axial-force bearing.

The radial-force bearing 3 comprises a cylindrical inner-race sleeve 5 shrunk-fit on a large-diameter portion 2*a* of the stepped stub 2, a pair of axially aligned outer-race sleeves 7 and 8 fixed in the frame 6, and four rows of cylindrical rollers 9 received in track grooves of the outer race sleeves 7 and 8 but riding on the cylindrical outer surface of the inner sleeve 5. Thus the rollers 9 engage the sleeve 5 in line contact so that they can withstand enormous radial forces, but the inner sleeve 5 can shift axially as indicated by arrow 10 in the housing 6 with minimal friction between the sleeve 5 and the rollers 9. These rollers 9 are here shown to be cylindrical, but instead the could be so-called needles or barrels, so long as they permit the inner race to slide axially relative to the outer race. Alternately the rollers 9 could be set in the inner race and could be slidable relative to the outer race.

The stub 2 is stepped down outward from the large-diameter portion *2a* of the roll 1 at *2b*, *2c*, and *2d* and is carried at the small-diameter region *2c* by an inner race sleeve 11 of the bearing 4. This race sleeve 11 forms a pair of axially oppositely directed frustoconical races and is braced by a ring 12 and a plurality of lock rings 13, 14, and 15 against the shoulder formed between the stub steps *2b* and *2c* so that it is solidly axially locked on the stub 2. The two races of the sleeve 11 carry respective arrays of oppositely tapered rollers 18 riding in respective outer races 17 fitted between outer bearing elements 16 and 19 that retain these sleeves axially relative to each other and hold the rollers 18 on the sleeve 11. Thus the outer bearing elements 16 and 19 are axially fixed on the stub 2 but can rotate relative thereto.

The outer bearing element 16 is formed with a radially outwardly projecting annular rim 20 that in effect forms a piston subdividing a chamber 22 defined by the elements 23 and 24 of the housing 6 into a pair of compartments 37 and 38. Seals 21 on the piston 20 and 25 on the housing parts 23 and 24 ensure fluid-tightness of the compartments 37 and 38.

Respective passages 26 and 27 and hydraulic lines 28 and 29 connect these compartments 37 and 38 to high- and low-pressure sides of a supply means having a reversing valve 30. Thus pressurization of, for instance, the inner compartment 37 and depressurization of the outer compartment 38 will push the piston/ridge 20 outward, that is to the left in the drawing, and will therefore shift the entire bearing 4 and, with it, the stub 2 and roll 1. Opposite pressurization will shift the stub 2 and roll 1 oppositely. Such shifting can take place while the roll 1 is rotating or stationary.

The nonrotatable outer part 24 of the housing 6 carries caps 34 and 35 that seal the outer end of the assembly, and the inner end is sealed against the roll 1 by a cuff 36.

The cover 34 carries an electric position detector 33 that engages the outer ring 19 and that is connected via lines 31 and 32 to a feed-back type controller 39 and thence to the valve 30 so that the position of the roll 1 can be accurately set.

We claim:

1. A roll stand comprising:

a generally stationary frame;

a roll centered on an axis;

a radial-thrust bearing having an outer race fixed in the frame, an inner race fixed on the roll, and a plurality of rollers radially engaging the races and supporting the roll in the frame for rotation about the axis, one of the races being axially substantially longer than the combined length of the rollers and the rollers being axially shiftable along the one race;

an axial-thrust bearing having an inner race axially fixed to the roll and an outer race formed with a piston, the frame forming around the piston of the axial-bearing outer race a cylinder chamber subdivided by the piston into a pair of axially opposite compartments, the cylinder chamber being radially spaced from the axial thrust bearing; and means for alternately pressurizing the compartments and thereby axially shifting the roll in the frame and thereby axially shifting the other of the radial-bearing races relative to the respective rollers and the one radial-bearing race.

2. The roll stand defined in claim 1 wherein the frame is formed of a plurality of parts together defining the chamber.

3. The roll stand defined in claim 1 wherein the rollers of the radial-thrust bearing have cylindrical outer surfaces extending parallel to the axis and engaging the respective races.

4. The roll stand defined in claim 1 wherein the radial-thrust bearing includes at least two sets of such rollers rotatable about respective axes inclined to the axis of the roll.

5. The roll stand defined in claim 1 wherein the outer radial-bearing race is formed with a radially inwardly open groove in which the respective rolls ride.

6. The roll stand defined in claim 7 wherein the inner race of the radial-thrust bearing is axially substantially longer than the outer race.

* * * * *